109-36 SR
8/8/78 XR 4,104,974

United States Patent [19]
Robinett

[11] 4,104,974
[45] Aug. 8, 1978

[54] TRANQUILIZER EJECTOR FOR DISABLING ROBBERS

[76] Inventor: Max L. Robinett, U.S. Hwy. 41 North, Hanson, Ky. 42413

[21] Appl. No.: 798,468

[22] Filed: May 19, 1977

[51] Int. Cl.[2] ..... E05G 5/00
[52] U.S. Cl. ..... 109/2; 43/59; 109/32; 109/36
[58] Field of Search ..... 109/2, 3, 6, 7, 8, 20, 109/29, 32, 36; 43/58, 59, 84

[56] References Cited

U.S. PATENT DOCUMENTS

| | | | |
|---|---|---|---|
| 538,968 | 5/1895 | Jackson et al. | 109/36 |
| 609,994 | 8/1898 | Meyer | 109/36 |
| 1,419,491 | 6/1922 | Clarkson et al. | 109/20 |
| 1,476,502 | 12/1923 | Fodor | 109/36 X |
| 2,283,542 | 5/1942 | Dorsey | 109/8 X |
| 3,779,178 | 12/1973 | Riseley | 109/6 |

*Primary Examiner*—Mervin Stein
*Assistant Examiner*—David H. Corbin
*Attorney, Agent, or Firm*—Clarence A. O'Brien; Harvey B. Jacobson

[57] ABSTRACT

A system for disabling robbers has an ejector arranged for projecting needle-like discrete articles across a passageway which a robber must traverse during flight, and toward a receptor disposed opposite of and spaced from the ejector across the passageway. Articles which do not strike the body of the robber will be received by the receptor. A tranquilizer is provided on the articles for rendering the robber unconscious in seconds. Personnel inside the building subjected to robbery can activate the system, either directly as the robber attempts to leave the building, or indirectly by actuating a sensor system when the robbery is first instigated.

4 Claims, 7 Drawing Figures

Fig. 4
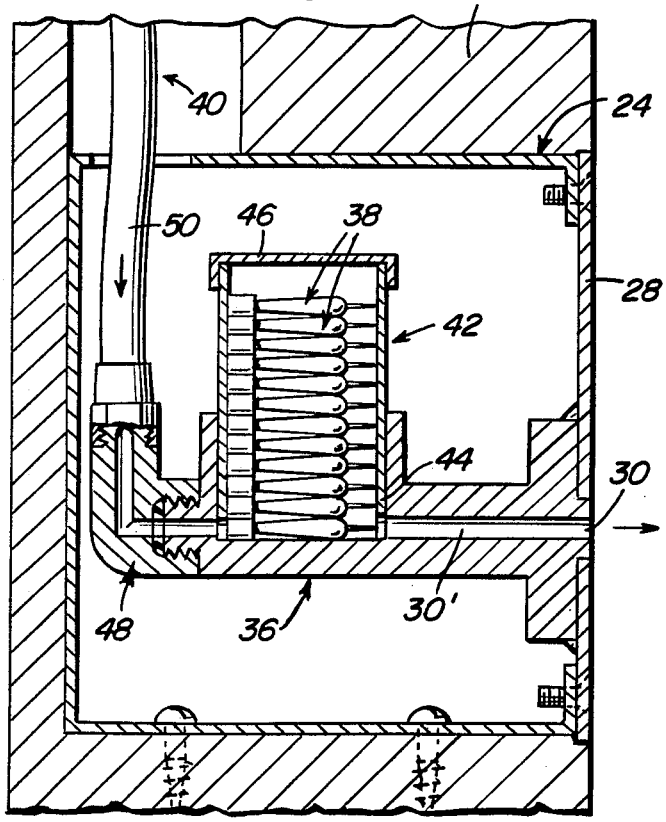
Fig. 5
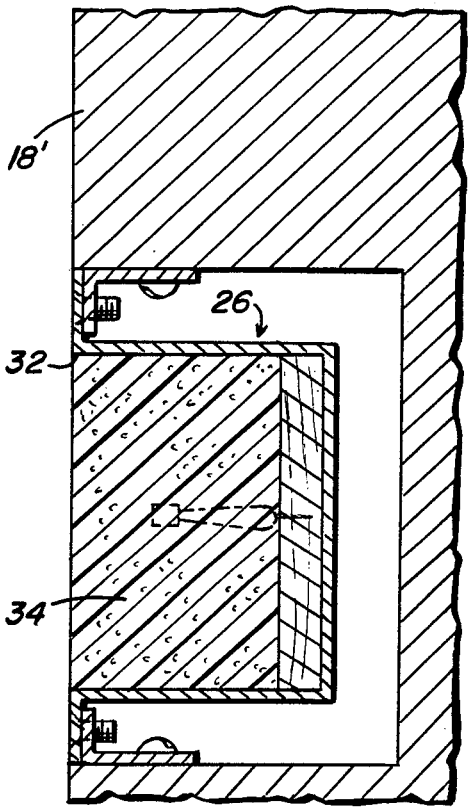
Fig. 6
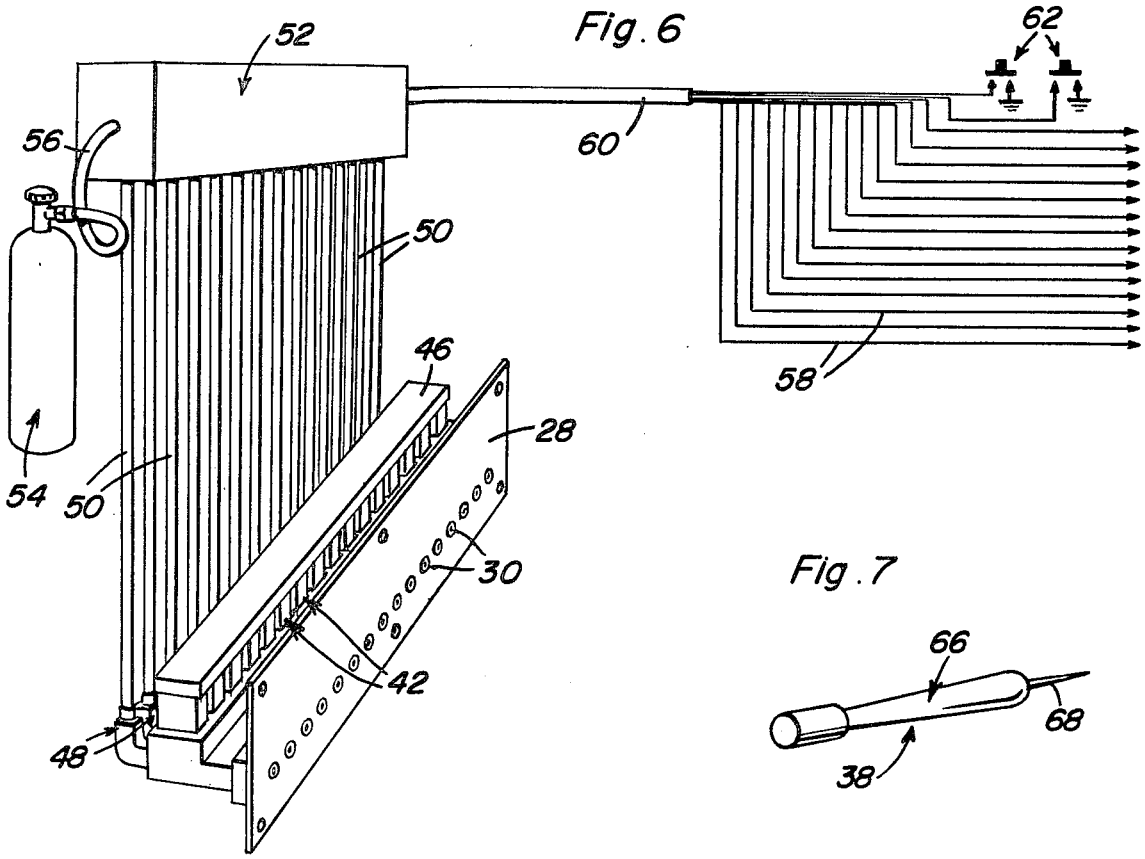
Fig. 7

TRANQUILIZER EJECTOR FOR DISABLING ROBBERS

BACKGROUND OF THE INVENTION

1. Field of the Invention

This invention relates generally to systems for apprending bank robbers, and the like, and particularly to such a system which will disable, and preferably render unconscious, robbers as same attempt to flee from a building in which they have perpetrated, or attempted to perpetrate, a robbery.

2. Description of the Prior Art

A never-ending problem encountered by banks and similar institutions is protecting the personnel and assets of the institution from robbers. In practice, most systems and techniques adapted involve actuation of a burglar alarm and protection of the tellers, or other appropriate personnel, behind bullet-resistant screens, and the like.

U.S. Pat. No. 1,522,218, issued Jan. 6, 1925, to H. Neiverth et al., discloses a burglar alarm which includes a mechanism for sequentially firing blank cartridges upon actuation of the alarm in an effort to frighten a burglar and cause him to flee the premises, thus aborting the robbery attempt. Further, U.S. Pat. No. 1,445,237, issued Feb. 13, 1923, to V. J. Price, discloses a safety device for banks wherein protecting screens are actuated upon an attempt to rob the bank, with the doors being simultaneously locked and an alarm sounded so as to trap the robbers within the bank while the bank personnel is protected by the screens. While this latter mentioned device would undoubtedly be very effective, it is very expensive to install in view of the extensive special construction required.

U.S. Pat. Nos. 1,890,670, issued Dec. 13, 1932, to F. J. Bridgeman, and 2,072,941, issued Mar. 9, 1937, to A. E. Burch, Jr., et al., disclose robbery protection systems which employ devices which dispense an appropriate gaseous substance upon actuation in order to abort the robbery attempt. Such devices have not found general use in banks and similar institutions, apparently because they easily can be neutralized by the use of gas masks.

It is generally known to propel discreet articles in the form of needles, and the like, carrying a quantity of a suitable drug for various purposes. Examples of such devices can be found in U.S. Pat. Nos. 993,023, issued May 23, 1911, to K. Burgsmuller, and 2,966,904, issued Jan. 3, 1961, to J. A. Crockford et al. These devices are generally employed for narcotizing animals in order to permit a person or persons to approach the animal in safety for whatever purpose, or to calm a rampaging animal without killing a possibly quite valuable property.

SUMMARY OF THE INVENTION

It is an object of the present invention to provide a system which will disable robbers in a simple yet efficient and reliable manner.

It is another object of the present invention to provide a system which will disable a robber as same attempts to flee from the scene of the crime so as to permit apprehension of the robber at the scene.

It is a still further object of the present invention to provide a system for disabling operators which can be installed in an existing building without substantial modification to the structure of the building.

These and other objects are achieved according to the present invention by providing a system having: an ejector arranged for projecting discrete articles across a passageway; and a receptor disposed opposite the ejector and spaced therefrom across the passageway for receiving articles projected from the ejector.

The ejector preferably includes a housing in which a guide arrangement is disposed for directing discrete articles from the housing and toward the receptor. A compressed fluid assembly is connected to the guide arrangement for propelling the discrete articles out of the housing. The guide arrangement includes a gravity-feed magazine arranged for holding a plurality of discrete articles and feeding the articles one at a time to an outlet bore extending from a lower portion of the magazine. The compressed fluid assembly communicates with the bore for propelling an article arranged therein from the housing of the ejector. Advantageously, there are a plurality of guide arrangements disposed side-by-side within the housing, with the latter having a side wall facing the receptor and provided with a plurality of apertures, each registering with the bore of a respective one of the guide arrangements.

The receptor preferably includes a housing having an open side facing the ejector, with a penetrable material being disposed in the housing of the receptor and arranged for retaining discrete articles impinging on the receptor.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is an enlarged, fragmentary, sectional view taken generally along the line 4—4 of FIG. 2.

FIG. 5 is an enlarged, fragmentary, sectional view taken generally along the line 5—5 of FIG. 3.

FIG. 6 is a partly schematic, perspective view showing the ejector portion of a robber disabling system according to the present invention.

FIG. 7 is a perspective view showing a needle-like projectile employed with the ejector of the present invention.

DESCRIPTION OF THE PEFERRED EMBODIMENTS

Figure 1:
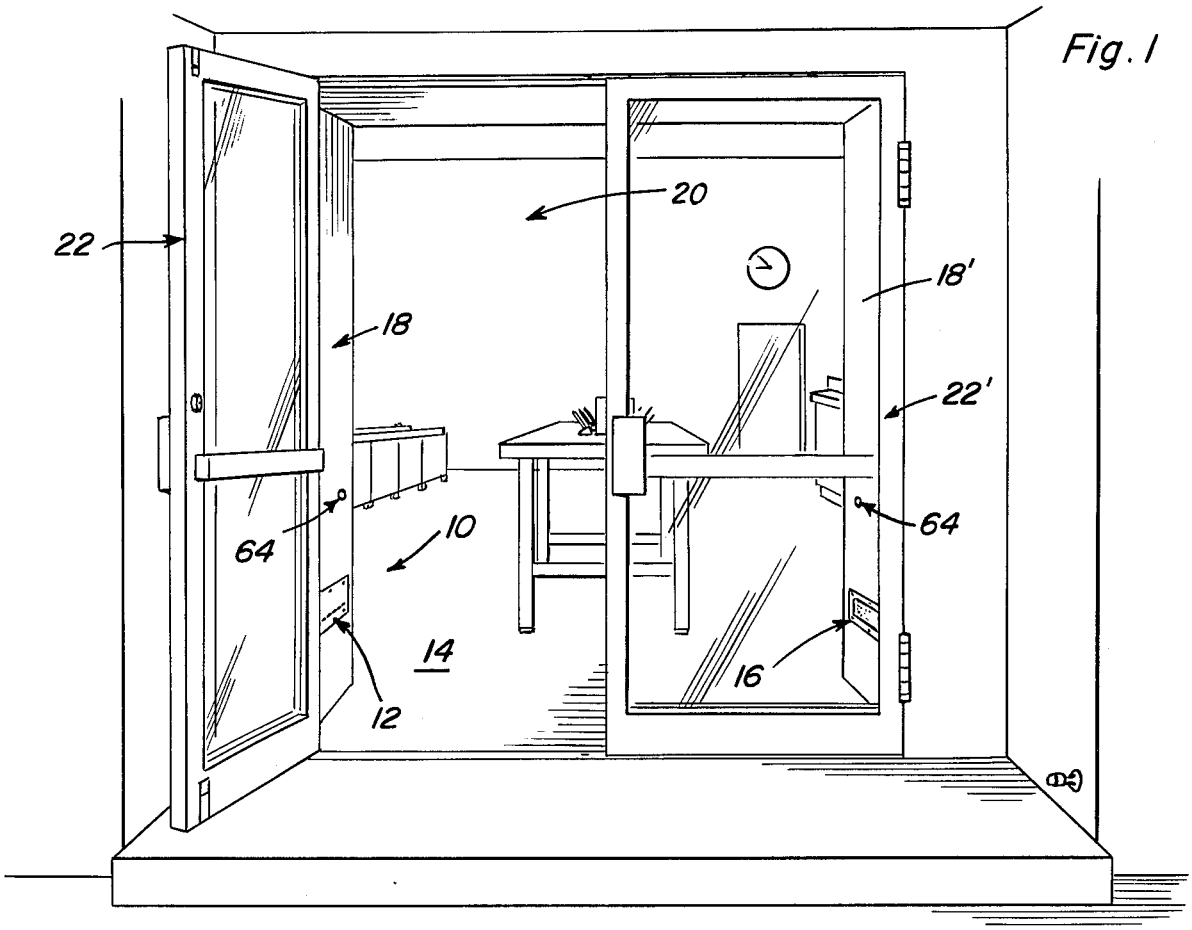
FIG. 1 is a schematic, perspective view of doorway of a bank or similar institution in which a robber disabling system according to the present invention has been installed.
Figure 2:
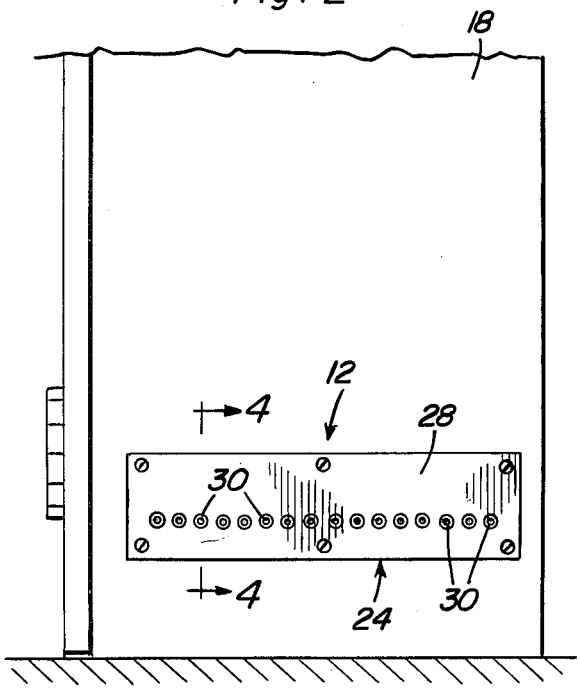
FIG. 2 is an enlarged, fragmentary, side elevational view showing the left hand side of the passageway seen adjacent the doors in FIG. 1.
Figure 3:
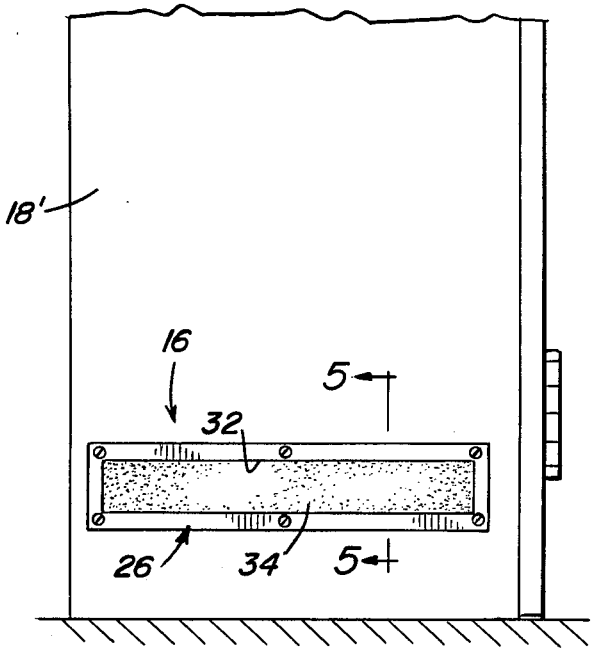
FIG. 3 is an enlarged, fragmentary, elevational view showing the right hand side of the passageway seen in FIG. 1.

Referring now more particularly to FIGS. 1 through 3 of the drawings, a system 10 according to the present invention for disabling robbers, and the like, includes an ejector 12 arranged for projecting discrete articles across a passageway 14 and a receptor 16 disposed opposite of and spaced from ejector 12 across passageway 14 for receiving articles projected from ejector 12.

System 10 is advantageously disposed, as illustrated, in the entranceway to a bank or similar institution, with such entranceway including spaced, substantially parallel side walls 18 and 18' leading to a lobby 20 from a doorway including doors 22 and 22'. As will be appreciated, such a structural arrangement is generally found at the entrance to buildings used as banks and similar establishments.

Ejector 12 and receptor 16 each include a respective housing 24 and 26 of substantially rectangular cross section and arrangeable so as to extend longitudinally along the passageway 14. Housing 24 is provided with a side wall 28 facing receptor 16 and provided with a plurality of apertures 30, each of which apertures 30 registers with the bore of a respective one of guide arrangements to be described below, which guide arrangements are disposed within housing 24. Housing 26 has an open side 32 disposed facing the ejector 12, with a penetratable material 34, which may be cork, or a suitable foam synthetic material known per se, being disposed in housing 26 and arranged for retaining discrete articles propelled from the apertures 30 of ejector 12 toward the open side 32 of receptor 16.

Referring now more particularly to FIGS. 4 through 6 of the drawings, as mentioned above, ejector 12 also includes a plurality of guide arrangements 36 mounted in housing 24 sequentially directing discrete articles 38 through an associated one of the apertures 30 provided in side wall 28. A compressed fluid assembly 40 is connected to the guide arrangements 36 for propelling articles 38 from housing 24.

Each of the guide arrangements 36 includes a vertically disposed magazine 42 having a lower portion 44 and arranged for holding a plurality of articles 38. A removable cap 46 disposed on the upper inlet portion of magazine 42 permits replenishing of articles 38. The lower portion 44 of magazine 42 is placed in communication with compressed fluid assembly 40 as by a suitable elbow fitting 48.

An outlet bore 30', which forms an extension of and is aligned with an associated one of the apertures 30, is also included in each of the guide arrangements 36 so as to be in communication with the lower portion 44 of the associated magazine 42 and permit an exit path for articles 38 from housing 24.

Compressed fluid assembly 40 includes a plurality of hoses 50 arranged in parallel extending from a regulatory module 52 which includes a suitable manifold, to which module 52 is connected a conventional compressed bottle 54 as by a hose 56. Carbon dioxide or other suitable gas can be used as the medium for projecting articles 38 from ejector 12.

Regulatory module 52 also acts to control operation of ejector 12. A plurality of, for example, electrically operated switches (not shown) are associated with the hoses 50 within module 52 so as to selectively permit gas from bottle 54 to pass through a particular guide arrangement 36. Although not critical to carrying out the invention, it is desirable that the guide arrangements 36 be fired in a predetermined sequence, such as, for example, one half second intervals from the first aperture 30 through the last for a period of, say, one to five minutes. A suitable timer (not shown) of conventional construction can be employed within module 52 to achieve this desired result in a known manner.

Wires 58, forming a cable 60, attach module 52 to, for example, tellers' cages, and the like, for actuation upon instigation of a robbery within the building provided with system 10. Conventionally, normally-open switches 62 are disposed at the end of each of the wires 58 to facilitate actuation of the system.

In order to prevent a robber from putting all of the tellers and other employees of the establishment being robbed into a vault, closet, or back room, so that no one will be able to actuate the device as the robber or robbers flee the building, a sensor assembly 64 is advantageously provided to detect movement through passage 14 at the lobby 20 side of walls 18 and 18'. See FIG. 1. Once the sensor assembly 64, which can be a conventional photoelectric device known per se, is actuated at initiation of a robbery or attempted robbery within the building associated with system 10, such actuation being made by the same switches 62 as used for direct actuation of jector 12, anyone who passes into passageway 14 from lobby 20 will start firing of the articles 38. Sensor assembly 64 is connected to module 52 in a known manner.

Articles 38 are advantageously in the form of an elongated, or needle-like element 66 as shown in some detail in FIG. 7 of the drawings. As can be seen, element 66 has the shape of a dart or similar projectile and terminates in a dart-like pointed tip 68. It is this tip which is to be provided with a suitable tranquilizer or other drug which will temporarily disable the robber in some manner, permitting his easy apprehension.

The specific tranquilizer or other drug employed in conjunction with the invention does not form part of the invention, and any suitable known tranquilizer or member of another class of drugs which will induce unconsciousness in a person within a relatively short period of time, such as 20 seconds, when fed into the person's bloodstream by intermuscle injection can be employed. An example of a fast-acting tranquilizer is hydroxyzene HCL.

As can be readily understood from the above description and from the drawings, robbers can be disabled by arranging ejector 12 and receptor 16 along opposite sides of passageway 14 which the robber or robbers must traverse during flight, and projecting discrete articles 38 from ejector 12 toward receptor 16 and striking the robber or robbers with at least some of the articles 38. The tranquilizing drug applied to the tip 68 of each article 38 will rapidly enter the bloodstream of the robber and disable same within seconds. The articles 38 which do not strike the robber or robbers will safely embed themselves in the penetratable material 34 disposed in housing 26 of receptor 16.

Although the height of ejector 12 and receptor 16 above the floor of passageway 14 is not critical, it is contemplated that this height will be such that the needle-like articles 38 will strike the robber or robbers in the legs. A height of approximately one foot from the floor of passageway 14 would be satisfactory.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A system for disabling robbers, comprising, in combination:

(a) ejector means arranged extending longitudinally along a long, narrow passageway for projecting discrete articles across the passageway in a continuous line along the length of the passageway, with at least some of the articles striking a fleeing robber; and (b) receptor means disposed opposite the ejector means and spaced from the ejector means across the passageway for receiving articles projected from the ejector means, the ejector means including, in combination:

(1) a housing extending longitudinally along substantially a length of the passageway;

(2) actuator means for actuating the ejector means;

(3) a plurality of guide means disposed side-by-side in the housing along the longitudinal extent thereof for directing discrete articles from the housing, the discrete articles including a tranquilizer and having a pointed shape; and (4) compressed fluid means connected to the guide means for propelling the discrete article in the guide means from the housing, the guide means being disposed for directing the articles toward the receptor means and including a vertically disposed magazine having a lower portion and arranged for holding a plurality of discrete articles, and an outlet bore extending from the lower portion of the magazine, with the compressed fluid means communicating with the bore, the housing has a side wall facing the receptor means and provided with a plurality of apertures, each of the apertures registering with the bore of a respective one of the guide means, the receptor means including a housing extending longitudinally coextensive with the housing of the ejector means, the housing of the receptor means having an open side facing the ejector means, with a penetrable material being disposed in the housing of the receptor means and arranged for retaining the discrete articles.

2. A system as defined in claim 1, wherein the discrete articles include a plurality of elongated elements each having a pointed tip.

3. A system for disabling robbers, comprising, in combination:

(a) ejector means arranged extending longitudinally along a long, narrow passageway for projecting discrete articles across the passageway in a continuous line along the length of the passageway, with at least some of the articles striking a fleeing robber; and (b) receptor means disposed opposite the ejector means and spaced from the ejector means across the passageway for receiving articles projected from the ejector means, the ejector means including, in combination:

(1) a housing extending longitudinally along substantially a length of the passageway;

(2) actuation means for actuating the ejector means;

(3) a plurality of guide means disposed side-by-side in the housing along the longitudinal extent thereof for directing discrete articles form the housing, the discrete articles including a tranquilizer and having a pointed shape; and (4) compressed fluid means connected to the guide means for propelling the discrete articles in the guide means from the housing, the guide means being disposed for directing the article toward the receptor means, the receptor means including a housing having an open side facing the ejector means, a penetrable material disposed in the housing and arranged for retaining the discrete article.

4. A system as defined in claim 3, wherein the discrete article includes an elongated element having a pointed tip.

* * * * *